US007802765B2

(12) United States Patent
Thieman

(10) Patent No.: US 7,802,765 B2
(45) Date of Patent: Sep. 28, 2010

(54) WALL STRUCTURE MOUNTED RETENTION DEVICE

(76) Inventor: Scott T. Thieman, 935 Teal Dr., Fort Collins, CO (US) 80521

( * ) Notice: Subject to any disclaimer, the term of this patent is extended or adjusted under 35 U.S.C. 154(b) by 534 days.

(21) Appl. No.: 11/824,015

(22) Filed: Jun. 28, 2007

(65) Prior Publication Data

US 2009/0001036 A1 Jan. 1, 2009

(51) Int. Cl.
*E04B 1/00* (2006.01)

(52) U.S. Cl. ..... 248/214; 248/215; 248/220.21; 248/220.41; 248/220.43; 248/222.14; 248/247; 248/309.1; 248/231.9

(58) Field of Classification Search ..... 211/86.01, 211/87.01, 89.01, 94.01; 248/214, 215, 220.21, 248/220.31, 220.41, 220.43, 222.14, 235, 248/247, 309.1, 231.91, 231.9
See application file for complete search history.

(56) References Cited

U.S. PATENT DOCUMENTS 3,941,343 A * 3/1976 Kennedy ..... 248/220.31
4,441,619 A * 4/1984 Gibitz ..... 248/220.41

* cited by examiner

*Primary Examiner*—Richard E Chilcot, Jr.
*Assistant Examiner*—Matthew J Smith

(74) *Attorney, Agent, or Firm*—Craig R. Miles; CR Miles, P.C.

(57) ABSTRACT

Retention devices and methods are disclosed that are mounted to the surface of a wall structure such as a wall surface or surfaces or a framing construction. The retention devices and methods may be used or performed in combination with one or more retaining elements, such as storage elements or fastener elements, such as traditional peg board hooks, pegs or hangers and even with other traditional fasteners such as screws, bolts, and nails. The invention comprises in some embodiments retention devices and methods, alone or in combination with or performed with the retaining elements, and retains materials, tools, and other implements. The invention in some embodiments may comprise a retention device having a plurality of perforations, and in some embodiments perforations configured the extent of a rail or panel. In some preferred embodiments, perforations are configured a minimum of two rows and equally spaced. Furthermore, storage and work space embodiments are disclosed providing adjustably retained storage or work place components that may be retained to a surface or surfaces of a wall or framing structure. Methods such as those corresponding to the devices and assemblies are also disclosed, as well as methods of doing business, methods of manufacture and products by process. Applications may include the implementation of additional storage to existing structures such as garages, sheds, off-site storage, and other storage solutions and may be provided in combination with traditional peg board technologies.

20 Claims, 6 Drawing Sheets

WALL STRUCTURE MOUNTED RETENTION DEVICE

BACKGROUND OF THE INVENTION

Technologies for the placement and storage of materials and tools are well known and are particularly applied in the implementation of additional storage to existing structures such as garages, sheds, off-site storage, and other storage solutions. Wall implemented technologies relating to peg board have historically dominated the market for hand-held tools and other light weight materials and implements to be stored.

Various forms of peg boards and attachment means have been previously developed to aid in storage on structural walls. Hooks and clasps have been developed that attach to the peg board and through one or more holes of the peg board. The size, weight and strength of the attachment means, usually a light-weight steel alloy or aluminum, may be limited by the size and thickness of the peg board and the material of the peg board, usually provided in sheets of various sizes and made from particle board. A further accommodation must typically be made for spacing behind the peg board to allow for the attachment, such as a hook or clasp, to insert into the peg board and between the peg board and the structural wall, as may be shown in the prior art of FIGS. 6A and 6B (hook or clasp not shown). The accommodation is typically the requirement of mounting the peg board upon a framing member such as a 1 inch by 4 inch piece of construction lumber that is further attached to the structural wall. The framing member, regardless of the material or configuration used, creates additional complication to the storage solution, creates additional mounting requirements and holes in the structural wall, and may even block some or many of the holes of the peg board, making the storage solution less attractive functionally as well as visually.

Another primary weakness of peg board systems has been the limitation of the strength of the peg board material and its inability to hold for any preferred duration any material or item of significant weight. Many attempts have been made to either 1) strengthen the attachment point of the attachment means to the peg board, or 2) strengthen the size, material and configuration of the board that was traditionally presented as particle peg board, including laminating the particle board and providing the board in different types of material, such as plastic or metal. Many of these attempts required such complexity in the construction and implementation of the system that in practice the technology is not affordable or is too time consuming in the installation and use of the product. Other attempts do not address the implementation of a system that provides functionality beyond the mere attachment of light-weight materials or tools. Still other attempts may have addressed full storage capacity, but are themselves too bulky, too complex, or do not afford the flexibility of a customized and adjustable storage solution.

One such example of previous technology is described in U.S. Pat. No. 3,452,959, wherein the holes have extensions or rings that are to provide additional strength about the hole. The ring or protuberance extends rearwardly from the plane of the board and it may be the intended purpose to protect the board from damage caused by the repetition of inserting hangers in and out of the board. Another such example is described in U.S. Pat. No. 5,927,517. However, these technologies do not provide an acceptable retaining feature for the attachment, do not provide other retaining features that may be necessary given the type of attachment used, and may not provide an acceptable accommodation for spacing between the hole and the structural wall for hangers or other attachments. Other such systems are described in U.S. Pat. Nos. 4,932,538 and 5,673,803. These systems describe holes in the panels to receive and retain to some extent attachments such as hooks. Again, however, these do not provide particular retention features that provide flexibility for other attachment means, do not provide other retaining features given the type of attachment used, and may not provide an acceptable accommodation for spacing between the hole and the structural wall for hangers or other attachments, restricting its application.

Another example of previous attempts to improve attachment and storage technologies are described in U.S. Pat. Nos. 6,530,486, 5,499,724 and 2,926,824 providing mounting plates with reduced diameter holes or holes on multiple faces of the mounting plates. These systems, although attempting to address the retention of hanging elements, lack the flexibility to accommodate many various attachment means and are limited in application to the configuration restraints of the systems, as well as suffering from the other limitations of the prior art as previously described.

Additional previous attempts are described in U.S. Pat. No. 6,530,486, wherein a pegboard assembly is provided and of a sheet metal construction, wherein hook attachments are provided via holes that allow for the hook to wedge into place. These types of systems have holes that limit the type of attachment means used and do not provide particular retaining features, including but not limited to providing for threaded attachment means, and further not accommodating still other commonly used attachments having more than one attachment point, such as hooks having two attachment points as shown in the prior art of FIG. 4A. The prior art of U.S. Pat. No. 6,530,486 also appears not to be mountable in other than the horizontal direction. Still other past attempts such as U.S. Pat. No. 6,061,909 again suffer from many of the above-described deficiencies. While the attempt is made, for example, to address the identified need to strengthen holes in panel systems, by creating a strengthened punched hole through extrusion forming steps as a straight wall annular flange, the hole and system configuration itself lacks the flexibility to accommodate many various attachment means as previously described and are limited in application to additional mounting systems for the storage solution.

In addition to all of the deficiencies previously described, the prior art may suffer from one or more of the following deficiencies. The prior art may require attachment systems and separate and additional mounting brackets or other mounting solutions as previously described. The prior art may not sufficiently accommodate various attachments between the attachment system and the structural wall, requiring that the attachment system be raised from the structural wall surface by a mounting solution. Regarding many of these systems, and as previously mentioned, one major concern is the structural integrity of the hole, particularly if a fastener such as a screw or bolt or other threaded means is required. Straight wall extrusion type technologies typically may fail when a threaded fastener is used, creating a deformation of the extrusion wall that will result in a split out, resulting in a less stable mount of the fastener or total failure of the material. In order to accommodate, prior art systems may also have required a heavier gauge material to properly retain threaded fasteners and for the depth from mounting surface needed for the straight wall extrusion, creating an undesirably heavy overall system. While still other configurations of extrusions may have been utilized in the past, such as a conical configuration, these also lack the capacity to sufficiently accommodate both a threaded fastener and other non-threaded attachments such as a hook, while still suffering from material deformation and failure as previously described.

SUMMARY OF THE INVENTION

Retention devices and methods are disclosed that are mounted to the surface of a wall structure such as a wall surface or a framing construction. The retention devices and methods may be used or performed in combination with one or more retaining elements, such as storage elements, as in traditional peg board hooks, clasps, hangers or rings, and even with fastener elements, as in screws, bolts, and nails. The invention comprises in some embodiments retention devices and methods, alone or in combination with or performed with retaining elements or retained elements generally, such as materials, tools, and other implements.

The invention in some embodiments may comprise a wall structure-mounted retention device having at least one perforation, and in some embodiments a plurality of perforations, each perforation having a first and second perforation surface extending within the perforation distances and having configurations unique of the present invention. The perforations in some preferred embodiments have perforation surfaces extending to predetermined distances beyond the front of the plate of the retention device and diameters unique of the present invention. The perforations may be configured the extent of a face of the retention device and may in some embodiments be provided as a panel or a rail, while other configurations are also feasible consistent with the present invention. In some preferred embodiments, perforations are configured in a minimum of two rows and equally spaced.

The perforations in preferred embodiments extend away from the front surface in a predetermined configuration and substantially a predetermined distance from the front surface. In some embodiments, the perforations are configured to be thread forming, are configured to be removably engaged with a retaining element, and in preferred embodiments to be removably engaged with a fastening element such as a screw or bolt, and in some embodiments with a particularly sized diameter of a retaining element. The perforations may accommodate either a storage element such as common peg board elements such as hooks or other hangers while also accommodating for threaded fasteners. The perforations also preferably accommodate storage elements having configurations for two insertion points for standard peg board holes that help secure the storage element. The perforations in accordance with the present invention comprise a configuration resistant to fracturing when in removable engagement with a fastening element.

Furthermore, in some embodiments, the invention comprises wall structure-mounted retention device having at least one perforation that is configured to be removably engaged with a retaining element while having a unique second perforation surface that is configured to be in threaded engagement with a threaded fastener element, offering expanded applications and structural stability not heretofore available. The configuration may comprise in some embodiments a configuration that is more structurally stable, particularly with respect to the predetermined distances of insertion points of peg board storage elements and the properties required for threaded engagement with threaded fasteners. Furthermore, the perforations may be a preferred displacement of the material of the device and not simply an extrusion of the material, thereby allowing for the features previously described while also allow for a plurality of retaining elements to be used, and in preferred embodiments, allowing for a plurality of thread-forming fastening elements and/or storage elements in combination with the perforations to form a removable engagement with the device. Other features are disclosed as embodiments of the invention.

Methods of retaining implements or materials to a wall structure are further disclosed. The steps may comprise in preferred embodiments of accommodating a retaining element capable of being removably engaged with at least one perforation and corresponding to a wall structure to which the retention device is mounted, accommodating for threaded engagement of a threaded fastener element with the perforation, and accommodating for removable engagement of a storage element with the perforation, removably engaging a retaining element with the perforation, and retaining an implement or material to the wall structure. In some preferred embodiments, the steps comprise providing a retention device and mounting the retention device in accordance with the present invention.

Furthermore, storage embodiments are disclosed providing adjustably retained storage or work place components that may be retained to a surface or surfaces of a wall or framing structure. Methods such as those corresponding to the devices and assemblies are also disclosed, as well as methods of doing business and methods of manufacture. Applications may include the implementation of additional storage to existing structures such as garages, sheds, off-site storage, and other storage solutions and may be provided in combination with traditional peg board technologies.

BRIEF DESCRIPTION OF THE DRAWINGS

FIG. 4A is a left side view of a storage element, namely a hook having two insertion elements that may be used with embodiments of the present invention; FIG. 4B is a side view of other fastening elements that may be used with embodiments of the present invention.

FIG. 6A is a cross-sectional view of holes of traditional peg board in relation to a mounting element such as construction wood (fastener element not shown); FIG. 6B is a cross-sectional view of traditional punched or extruded holes in relation to a mounting element such as construction wood (fastener element not shown).

FIG. 7 are side and cross-sectional views of an embodiment of the present invention.

DETAILED DESCRIPTION OF PREFERRED EMBODIMENTS OF THE INVENTION

The present invention is described in preferred embodiments that address one or more inadequacies of the prior art. Accordingly, embodiments of the invention are shown and described in the Figures, written description, and claims and throughout the disclosure of this application.

The present invention in preferred embodiments is wall structure mounted. Accordingly, preferred embodiments of the invention may be mounted to a surface of a wall, such as a garage wall or other residential or commercial wall, or even other wall structures, such as wooden framing, or other vertical supportive surface understood by those skilled in the art and to which previous technologies such as peg board have been applied.

Figure 4:
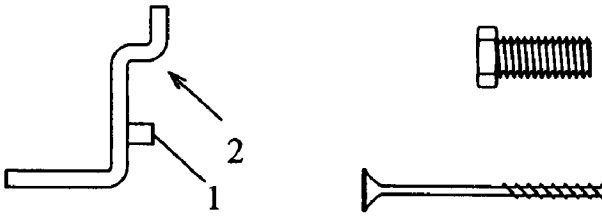
FIG. 4 A Prior Art
FIG. 4 are traditional retaining elements such as storage elements and fastener elements.
Figure 4:
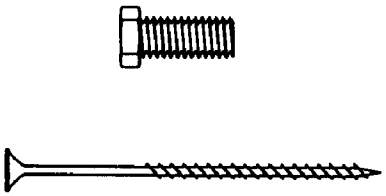
FIG. 4 B Prior Art

Furthermore, the present invention in some preferred embodiments is directed to be implemented in combination with common retaining elements. These retaining elements may include, but the invention not being limited to the following as one skilled in the art would appreciate: storage elements, such as hooks, clasps, pegs, supports, hangers or rings, and particularly storage elements having at least two insertion elements, such as the hook shown in FIG. 4A. The retaining elements may include, but the invention not being limited to the following as one skilled in the art would appreciate: fastener elements, such as nails, screws, or bolts, and particularly threaded fastener elements such as many screws and bolts, such as the fasteners shown in FIG. 4B.

Figure 6:
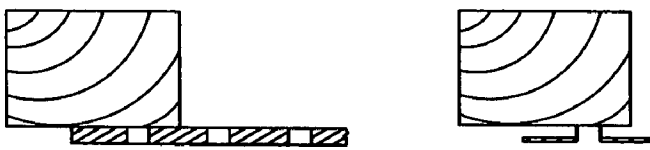
FIG. 6 A Prior Art
FIG. 6 are traditional holes of the prior art.
Figure 6:
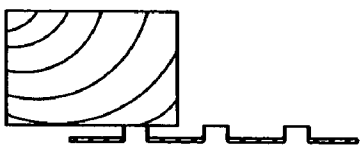
FIG. 6 B Prior Art

FIGS. 6A and 6B also describe certain traditional retention systems such as peg board, depicted in FIG. 6A along with a mounting element such as structural support or in some cases 1 inch by 4 inch construction wood, and reinforced or extruded straight wall holes of peg board or other retention systems depicted in FIG. 6B.

Two particular advantages stem from the present invention and in relation to the prior art. One is the novel production of the perforation as compared to the holes of traditional systems. Configurations of the perforation surface, and in some embodiments of the perforation generally, comprise a combination of conical and cylindrical surfaces that allow for the functionality of use of storage elements described above while further allowing for the fastening of fastener elements with a perforation surface. When fastening a fastener element or even a non-threaded storage element such as a hook to a perforation surface of the perforation of the present invention, the structural integrity of the perforation is maintained, whereas traditional systems such as peg board may likely split out or the material will otherwise fail from the inherent weakness of the material.

Specifically, in traditional systems such as fibrous wood peg board, failure may occur for fastener elements or even storage elements given the thickness or strength of the material at the hole. For traditional metal and straight-wall holes, failure may still be a problem given the extrusion process used to create the hole. Material may be deformed to the extent that the deformed material or its reduced thickness results in a hole that is mechanically fatigued or that will otherwise fail under attachment of a retention element, and particularly when attempting to thread a fastener. The extrusion process itself for metal and traditional holes causes failure given that the material drawn to the required depth for a peg board hook, for example, in relatively thin gauge metal will reduce in thickness and otherwise weaken. A minimum thickness is required to maintain structural integrity of the hole and the wall for fastener application or even storage element use and traditional light gauge extrusion will extrude the wall to an unacceptable thickness for threaded fasteners.

Furthermore, the straight-wall hole and peg board hole will not typically accommodate a distance necessary for removably engaging retaining elements. For example, storage elements such as hooks for peg boards need a pre-determined distance of engagement with the retention device in order for the storage element to be retained without easily sliding or otherwise moving out of the hole, particularly when the weight of an implement or material is applied to the retaining element. This distance is typically a length of an insertion point or even two or more insertion points of the storage element, such as the insertion elements 1, 2 depicted as dog legged and stubbed extensions of the prior art.

Figure 1:
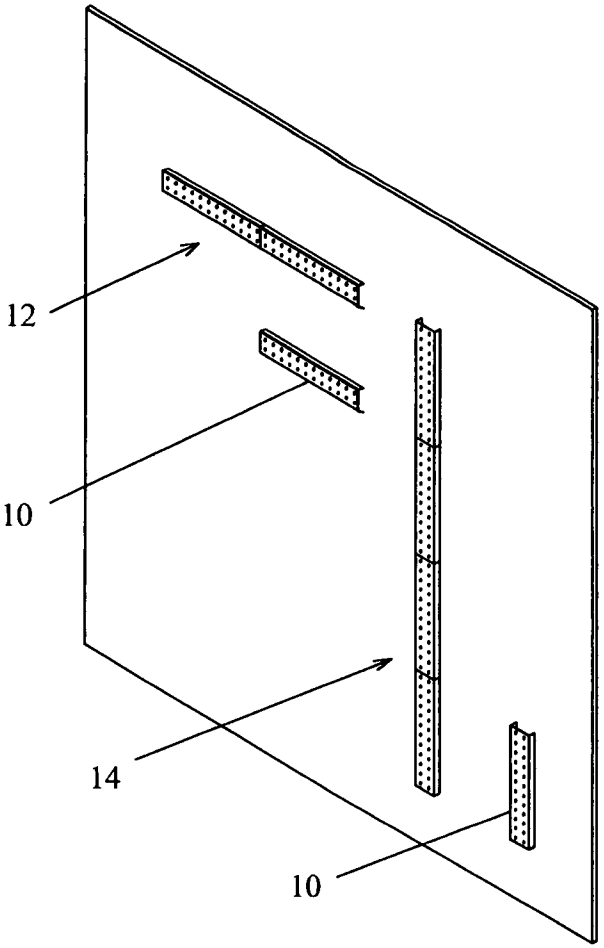
FIG. 1 is an isometric view of some embodiments of the present invention.

Accordingly, FIG. 1 describes several of the preferred embodiments of the present invention. Retention device 10 may be configured to any wall structure as shown and may have a linear profile in some embodiments. Other embodiments may be configured in the form of a rail, while still others may be configured in the form of a panel. Retention device 10 may be mounted on the wall structure such as in a vertical or horizontal configuration, may be linearly positioned adjacent one or more additional retention devices 12, 14.

Figure 2:
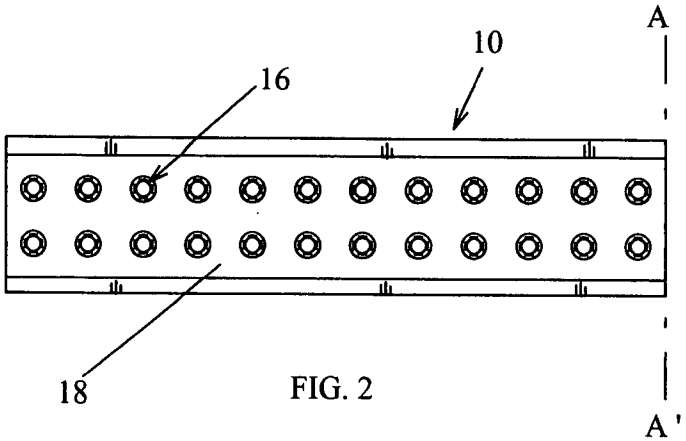
FIG. 2 is a front view of a retention device in accordance with an embodiment of the present invention.
Figure 3:
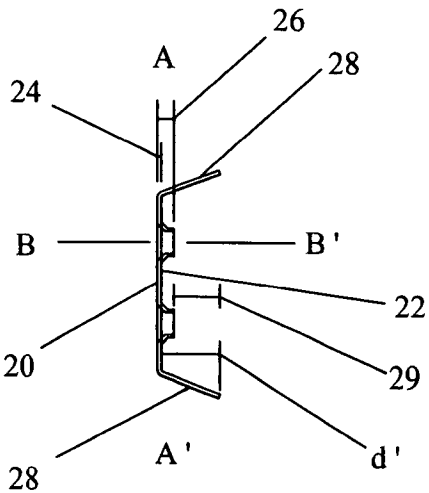
FIG. 3 is a cross-sectional view A-A' of FIG. 2 of a retention device in accordance with an embodiment of the present invention.

Now in reference to FIGS. 2 and 3, retention device 10 is shown in detail and in cross-section FIG. 3 describing the plurality of perforations 16 of the present invention. Embodiments of the invention may provide perforations equally spaced and in a minimum of two rows, or wherein at least one perforation is provided. More particularly, retention device 10 may comprise a plate 18, a front surface 20, a rear surface 22, a thickness of the plate 24 extending from the front to the rear surface, and at least one perforation 16. The perforation is configured to engage a retaining element and extends from the front surface of the plate to a distance beyond the rear surface of said plate, described as distance 'h' in FIG. 5 and as shown as distance 26 in FIG. 3. This distance may be a predetermined distance in some embodiments, accommodating retaining elements, such as storage elements or fastener elements, to be removably engaged and so as to accommodate for a wall or wall-structure to which the device is mounted.

Figure 10:
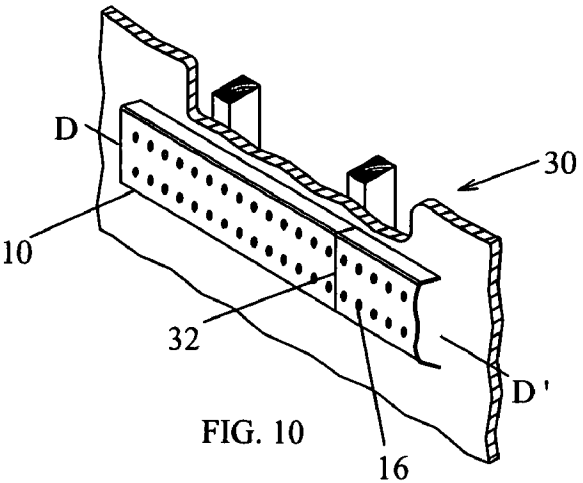
FIG. 10 is an isometric and partially cross-sectional view of an embodiment of the present invention.
Figure 11:
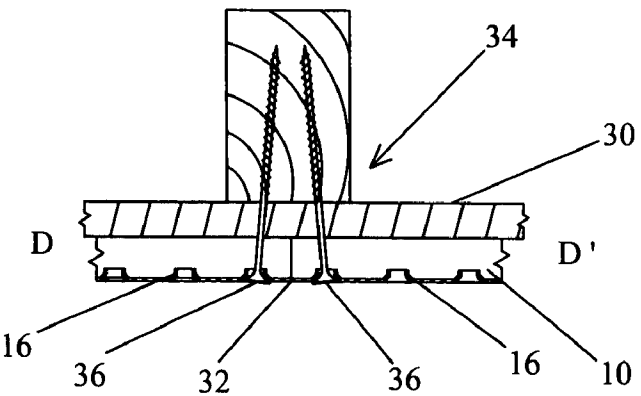
FIG. 11 is a top and partially cross-sectional view D-D' of FIG. 10 in accordance with the present invention.

In further reference of FIG. 3, at least two mounting surfaces 28 extend from the front surface of the plate to a predetermined distance beyond predetermined distance of the perforation beyond the rear surface. In preferred embodiments mounting surfaces 28 comprise flanges. The flanges may be configured oblique to the front surface of the plate, as described in FIG. 3. The extension of the mounting surfaces provide for the contact with the wall structure. Further, the mounting surfaces extend from the front surface of the plate to a predetermined distance accommodating a retaining element within the perforation, and in some embodiments accommodating a retaining element that capable of being removably engaged with the at least one perforation and a wall structure to which the retention device is mounted. This extension of the mounting surface and the predetermined distance are most easily in seen in all figures, but particularly that of FIGS. 7 with the retaining elements in place (wall structure not shown) and as shown generally in FIG. 10 with respect to implementation of the invention with a wall structure 30 and the provision of two retention devices configured adjacent each other at 32. The wall structure 30 may comprise wall material and even wall studs 34, and the retention devices may be configured to be mounted via fastener elements 36 fastened in perforations 16 as shown in FIG. 10.

Figures 8, 9:
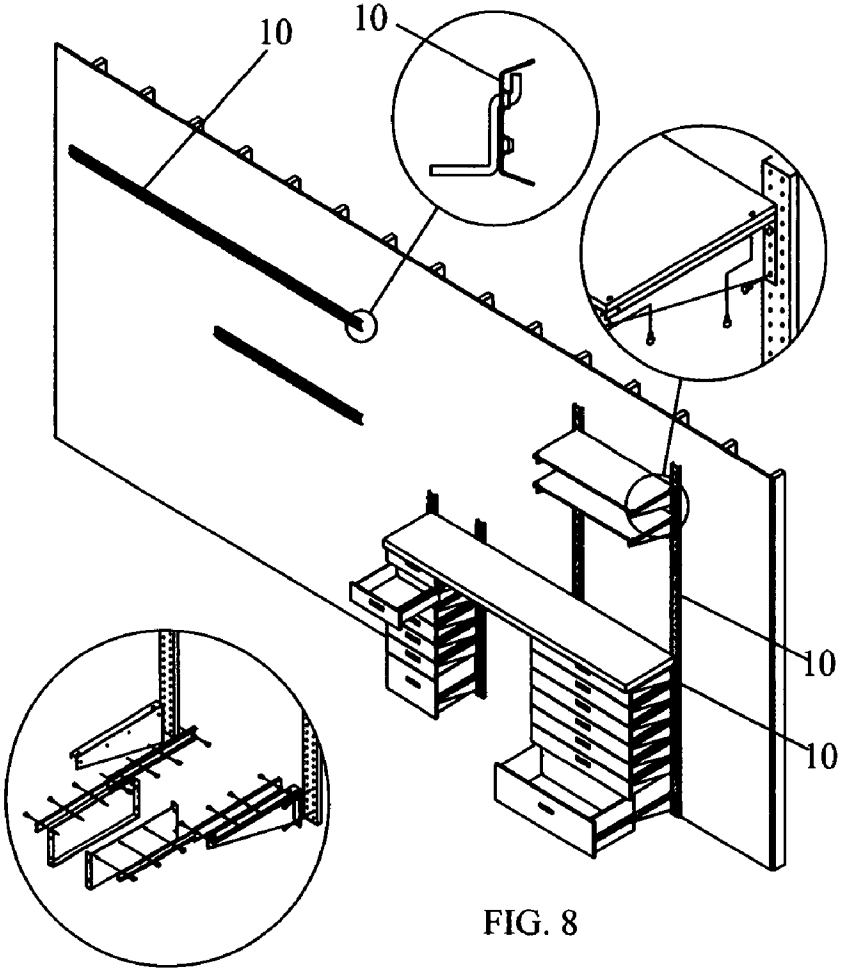
FIG. 8 are an isometric view and magnified views of a storage assembly and other embodiments in accordance with the present invention.
FIG. 9 is an exploded view of embodiments of FIG. 8 in accordance with the present invention (drawer components not shown).

Further embodiments of the invention may comprise storage or work space assemblies as described in FIGS. 8 and 9. The retention devices 10 are implemented for a wall structure to provide retention of supportive elements such as shelves, cabinets and work space support.

Now, again with reference to FIGS. 3 and 5, further details of the invention of some embodiments are described. A first perforation surface 34 extends within each perforation from the front surface of the plate to a distance 36 beyond the front surface of the plate, and in some embodiments, distance 36 is a predetermined distance. A predetermined distance may be required in some applications, for instance, in order to accommodate retaining elements, such as storage elements or fastener elements, to be removably engaged and so as to accommodate for a wall or wall-structure to which the device is mounted. A second perforation surface 38 extends within each perforation from the distance 36 beyond the front surface of the plate to a distance 40 beyond the front surface of the plate. Distance 40 may also be predetermined as previously described.

Figure 5:
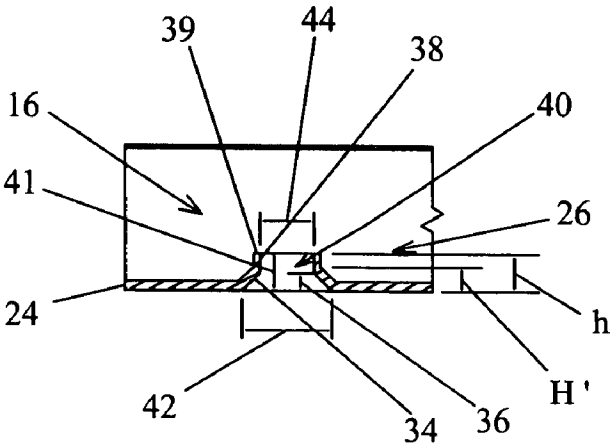
FIG. 5 is a cross-sectional view B-B' of a perforation and retention device of FIG. 3 in accordance with an embodiment of the present invention.
Figure 7A:
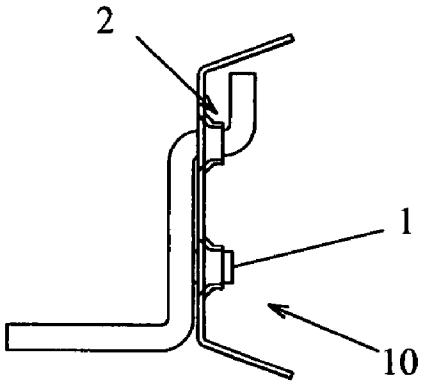
FIG. 7A is a left side view of a storage element and retention device and perforations in accordance with an embodiment of the present invention.
Figure 7B:
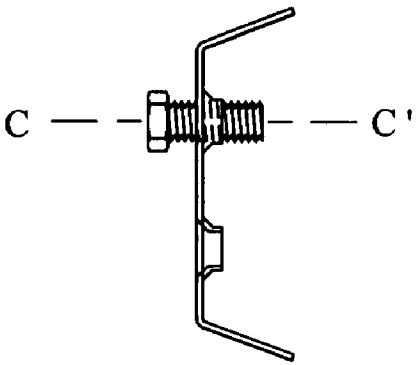
FIG. 7B is a right side view of a fastening element and retention device and perforations in accordance with an embodiment of the present invention.
Figure 7C:
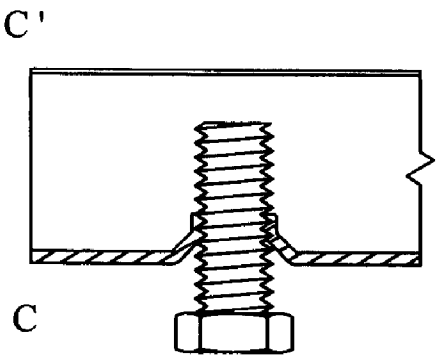
FIG. 7C is a cross-sectional view C-C' of FIG. 7B of a fastening element, retention device and perforation in accordance with an embodiment of the present invention.

The first and second perforation surfaces are shown in FIG. 5 in cross-section; however, in full dimension these surfaces in some preferred embodiments are configured as conical for the first perforation surface and cylindrical for the second surface. In general, as shown in FIG. 5, the second perforation surface is perpendicular to the front surface of the plate. However, other configurations are disclosed as embodiments of the present invention, such as a tapered perforation, and in some embodiments, a tapered second perforation surface. The perforation in such embodiments would be reduced in size to accommodate a retaining element. These surfaces facilitate releasable engagement with retaining elements, provide greater structural support to the perforation, and allow for releasable engagement of the threaded fastener elements, such that the threads of the fastener may thread form engagement into the second perforation surface as shown in FIG. 7C, in some embodiments referred to as threaded engagement. Furthermore, the predetermined distance of the extension elements of the storage element, such as the dog legged and stubbed extensions shown in FIG. 7A, are accommodated to provide releasable engagement, engagement not achieved as in the present invention, as accommodating the retaining element and corresponding to the wall structure to which the retention device is mounted, and in some instances, the distance to the wall structure.

Again in reference to FIG. 5, embodiments of the invention are disclosed as having apertures of the perforation that are defined by the perforation. In the embodiment shown in FIG. 5, a first aperture 41 is defined by the second perforation surface 38 and has a first perforation aperture extent 44 at the distance 36. The first aperture 41 has a second perforation aperture extent 44 at the distance 40. In one embodiment, the perforation aperture extents are equal. In other embodiments, the second perforation aperture extent may be less than the extent 44, the perforation aperture thus narrowing from the first distance 36 to the second distance 40. Embodiments having curved, single surfaces, such as a second perforation surface configured in a cylindrical or conical shape, the first and second perforation aperture extents may be first and second perforation aperture diameters. In some embodiments, a third perforation aperture 43 is defined by the first perforation surface, and in some preferred embodiments has a perforation aperture extent 42 greater that the first and second perforation aperture extents.

A first perforation surface extent, in some embodiments diameter 42, of the first perforation surface is defined by the first perforation surface at the front surface of the plate, while a second perforation surface diameter 44 of the first perforation surface is defined at a predetermined distance H' beyond the front surface of the plate, wherein in preferred embodiments the second perforation surface diameter is less than the first perforation surface diameter. In some embodiments, a third perforation surface diameter is defined at the predetermined distance 'h' in FIG. 5. In some preferred embodiments the third perforation surface diameter is the same diameter as the diameter 44, such that the third perforation surface diameter is the diameter of said second perforation surface diameter.

The present invention, however, may comprise other embodiments wherein the third perforation surface diameter may be a diameter less than the second perforation surface diameter, comprising a further taper of the second perforation surface. Accordingly, the second perforation surface may comprise a number of different configurations in different embodiments. While a cylindrical shape of the second perforation surface may be disclosed in the figures, other configurations may be utilized, such as a conical configuration having tapered features as described or other shapes.

Some further preferred embodiments of the invention are now described. The second perforation surface is perpendicular to the front surface of the plate in light of the previous description. Accordingly, the second perforation surface may be a cylindrical perforation surface and even a thread forming perforation surface. Further when the retaining element is a storage element having two insertion elements, such as shown in FIG. 7A, the second perforation surface, in some embodiments the thread forming perforation surface, is configured to be removably engaged with one of the insertion elements and a second perforation is configured to be removably engaged with the second insertion element, as previously described with reference to FIG. 4A. Accordingly, a removable engagement of storage element and retention device is created that provides for a secure engagement even with the storage element under load from supporting some material or implement. A further removable engagement of this type with a storage element such as a two-insertion element peg board hook is shown in FIG. 7A, with a predetermined distance configured for the retention device such that the insertion elements 1, 2 can be removably engaged and to minimize movement or disengagement of the storage element. A similar removable engagement of a fastener element is described in FIGS. 7B and 7C, wherein the second perforation surface is in removably threaded engagement with the fastener.

Furthermore, the first perforation surface is configured oblique to the front surface of the plate, and in preferred embodiments, is configured at an approximate 45 degree angle to the front surface of the plate as described in the figures. Additional embodiments may be configured such that an angle of the first perforation surface is of varying degrees. Accordingly, in some preferred embodiments, the first perforation surface is a conical perforation surface in full dimension.

As previously described, the retention device can be configured with a plurality of perforations and may be provided in a minimum of two equally spaced rows in some preferred embodiments. In other embodiments of the invention, the retention device may be sized similar to larger panel configurations as one skilled in the art would appreciate, having a plurality of perforations extending a face of the panel. In one embodiment, a plurality of rows of perforations may extend the face of the plate of the retention device, not merely two rows, such that a larger dimensioned device may be available for more retention capability.

The structural integrity of the present invention can be even more fully appreciated when considering the manufacture of the perforation and the perforation surfaces. The perforation of the present invention is produced as a displacement of the material of the retention device, in some embodiments the plate. The displacement of the material of the device, namely the plate, and the front and rear surfaces is described in FIG. 5. One may see the displacement as the first and second retention surfaces 34, 38 are displaced rearward (in the upward direction of FIG. 5) such that the perforation is not simply an extrusion and deformation of the plate but a predetermined displacement and configuration. Accordingly, in some embodiments, the perforation wall 39 maintains a thickness approximate to the plate thickness 24. The result is a perforation and retention device that will resist split out of the perforation wall and a device that may be constructed from thinner gauge material.

The invention further comprises the methods, methods of doing business, methods of manufacture, as previously described and as disclosed below. Furthermore, the invention may comprise the following steps as methods of retaining implements or materials to a wall structure as may be appreciated from the previous description and as further described below.

Methods of retaining implements or materials to a wall structure are further disclosed. The steps may be described in some preferred embodiments, and in conjunction with the description and figures previously presented, as comprising a step of accommodating a retaining element with a retention device corresponding to the wall structure. The retaining element is capable of being removably engaged with at least one perforation of the retention device as shown for the number of embodiments of the present invention and particularly in FIG. 7 and FIGS. 8 through 11.

A further general step in practicing the invention may be accommodating for threaded engagement of a threaded fastener element with the at least one perforation, and accommodating for removable engagement of a storage element with the perforation, as shown, for example, in FIG. 7. Removably engaging a retaining element with the perforation, and retaining an implement or material to the wall structure, are final steps in one embodiment of practicing the invention, and can be seen in reference, for example, in FIG. 7 and FIGS. 8 and 9, as well as disclosed previously. In some preferred embodiments, the steps comprise providing a retention device and mounting the retention device in accordance with the present invention, as shown for example in FIG. 1 and FIGS. 8 through 11.

In one embodiment, the invention comprises providing a retention device 10 having a front and rear surface 20, 22 and at least one perforation 16 extending a predetermined distance 26 beyond the rear surface, such as shown in FIGS. 3 and 5. The at least one perforation has a first and a second perforation surface as described above. The first perforation surface extends within each of a corresponding perforation from the front surface to a predetermined distance beyond the front surface, the second perforation surface extending within each said perforation from the predetermined distance beyond the front surface to a predetermined distance beyond said front surface, again as previously described.

Mounting the retention device to the wall structure may be performed by at least two mounting surfaces, in some embodiments the oblique flanges, of the retention device extending from the front surface to a predetermined distance d', shown in FIG. 3, a distance 29 beyond the predetermined distance of the perforation beyond the rear surface, again as described previously and as shown in the figures. The invention further provides the step of accommodating a retaining element, the retaining element capable of being removably engaged with the at least one perforation and a wall structure to which said retention device is mounted, as previously described and as shown in FIG. 7 (wall structure not shown in FIG. 7) and as shown generally in FIG. 10 with respect to implementation of the invention with a wall structure 30 and the provision of two retention devices configured adjacent each other at 32.

As previously described, an important aspect of the invention is accommodating for threaded engagement of a threaded fastener element with the second perforation surface, providing a more reliable and structural engagement as well as simply providing the ability to have a threaded engagement for retaining elements. FIG. 7C is an example of this novel aspect of the invention. Further, accommodating for removable engagement of a storage element with the second perforation surface, as described for example in FIG. 7A, and even removably engaging a retaining element with said at least one perforation to the predetermined distance beyond said rear surface, are all functional aspects of the invention that provide a secure removable engagement.

Further functional and process features may be realized from the present invention. A retaining element can be removably engaged so that in some embodiments the retaining element is threadingly engaging a threaded fastener element with the second perforation surface, again as seen in FIG. 7B, 7C. The step of threadingly engaging a threaded fastener element may even be performed by threadingly engaging a threaded fastener element with the second perforation surface beyond the first perforation surface, again as shown in FIGS. 7B/7C, providing a more flexible approach to retention of implements or materials.

Providing a panel as a retention device, or even as a rail, as may be known for particular size configurations of retention devices, is fully supported by the present invention. Such configurations lend themselves to particular profiles for retention applications and storages, such as providing a retention with a linear profile, such as the configurations shown mounted in FIG. 1, and further so that mounting the retention device adjacent to at least one or additional retention devices can be accomplished for specific applications requiring an extension of retention capability, such as those applications described in FIGS. 8 and 9.

The invention is further disclosed wherein the step of mounting the retention device comprises mounting the retention device linearly adjacent to at least one additional retention device, as described in FIG. 1. FIG. 1 is also useful in reference to further configurations wherein mounting is performed so that the retention device is mounted vertically or horizontally. Furthermore, as previously described, the provision of a retention device having a plurality of perforations configured in a plurality of rows is supported, such that, for example panel or other applications having larger size configurations is supported.

Important to the processes of the invention, and the structural integrity as previously described, is the forming a perforation retention surface of the second perforation surface, such as threadable engagement as shown in FIG. 7B, 7C, for example, by simply threading the retaining element into the perforation and threading the second perforation surface.

Additional aspects of the invention are further realized as methods of business. As but one example, a method of installing retention systems to a wall structure can be conducted as part of services or delivery of the system. The invention accordingly may comprising the step of determining a storage need and storage configuration of a wall structure, as may be ordered by the customer or as is otherwise a requirement for installation. Further steps include: providing at least one retention device having a front and rear surface and at least one perforation extending a predetermined distance beyond the rear surface, the at least one perforation having a first and a second perforation surface, the first perforation surface extending within each perforation from the front surface to a predetermined distance beyond the front surface, the second perforation surface extending within each perforation from the predetermined distance beyond the front surface to a predetermined distance beyond the front surface; mounting the retention device to the wall structure by at least two mounting surfaces of the retention device extending from the front surface to a predetermined distance beyond the predetermined distance of the perforation beyond the rear surface; and accommodating a retaining element with the retention device corresponding to the wall structure, the retaining element capable of being removably engaged with the at least one perforation of the retention device; accommodating for threaded engagement of a threaded fastener element with the second perforation surface; and accommodating for removable engagement of a storage element with the second perforation surface. The process as described above and as disclosed as part of and an embodiment of the invention, yields the installation of the storage device to a wall structure and the completion of the service.

Manufacturing methods and products by process are clearly defined as features of the present invention, and may further be disclosed as methods of manufacturing wall-mounted retention devices, consistent with the present invention as previously described.

As can be easily understood from the foregoing, the basic concepts of the present invention may be embodied in a variety of ways. It involves techniques as well as one or more apparatus, device and assembly, as well as devices, assemblages and several apparatus that may provide for the appropriate techniques. In this application, the techniques of the present invention in some embodiments are disclosed as part of the results shown to be achieved by the various devices, assemblages and several apparatus described and as steps that are inherent to utilization. They are simply the natural result of utilizing the devices, assemblages or several apparatus as intended and described. In addition, while some devices and apparatus are disclosed, it should be understood that these not only accomplish certain methods but also can be varied in a number of ways. Importantly, as to all of the foregoing, all of these embodiments are encompassed by this disclosure.

Further, each of the various elements or steps of the invention may also be achieved in a variety of manners. This disclosure should be understood to encompass each such variation, be it a variation of an apparatus embodiment, a method or process embodiment, or even merely a variation of any element of these. Particularly, it should be understood that as the disclosure relates to specific features of the invention, the words for each feature may be expressed by equivalent apparatus, device, assembly or method terms—even if only the function or result is the same. Such equivalent, broader, or even more generic terms should be considered to be disclosed for each element, step, or action. Such terms can be substituted where desired to make explicit the implicitly broad coverage to which this invention is entitled. As but one example, it should be understood that all actions or functions may be expressed as a means for taking that action or achieving that function, or as an element which causes that action or has that function. Similarly, each physical element disclosed should be understood to encompass a disclosure of the action or function which is facilitated by that physical element.

Any acts of law, statutes, regulations, or rules mentioned in this application for patent; or any patents, publications, or other references mentioned in this application for patent are hereby incorporated by reference. In addition, as to each term used it should be understood that unless its utilization in this application is inconsistent with such interpretation as would be understood by one of ordinary skill in the art from this disclosure, common dictionary definitions should be understood as incorporated for each term and all definitions, alternative terms, and synonyms such as contained in the Random House Webster's Unabridged Dictionary, second edition are hereby incorporated by reference. However, as to each of the above, to the extent that such references, information or statements incorporated by reference might be considered inconsistent with the patenting of the invention, such as contradicting disclosed features ascertained by a reading of these patent documents, such information and statements are expressly not to be considered incorporated by reference and more particularly as not made by the Applicant. Furthermore, as to any dictionary definition or other extrinsic evidence utilized to construe this disclosure, if more than one definition is consistent with the use of the words in the intrinsic record, the claim terms should be construed to encompass all such consistent meanings.

Furthermore, if or when used, the use of the transitional phrase "comprising" is used to maintain "open-end" disclosure herein, according to traditional disclosure and claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

I claim:

1. A wall structure-mounted retention device, comprising:

a plate;

a front surface of said plate;

a rear surface of said plate;

a thickness of said plate extending from said front surface to said rear surface;

at least one perforation in said plate configured to engage a retaining element and extending from said front surface of said plate to a distance beyond said rear surface of said plate;

a first perforation surface extending within each said perforation from said front surface of said plate to a distance beyond said front surface of said plate and said first perforation angled less than ninety degrees;

and a second perforation extending from the first perforation and extending within each said perforation from said distance beyond said front surface of said plate to a second distance beyond said front surface of said plate.

2. A wall structure-mounted retention device as described in claim 1, wherein said second perforation surface comprises a thread forming perforation surface.

3. A wall structure-mounted retention device as described in claim 2, wherein said thread forming perforation surface is configured to be removably engaged with a retaining element.

4. A wall structure-mounted retention device as described in claim 1, further comprising a second perforation, wherein said at least one perforation is configured to be removably engaged with a storage element having at least two insertion elements, wherein said at least one perforation is configured to be removably engaged with one of said insertion elements and said second perforation is configured to be removably engaged with a second of said insertion elements.

5. A wall structure-mounted retention device as described in claim 1, further comprising a perforation aperture defined by said second perforation surface, said perforation aperture having a first perforation aperture extent at said first distance beyond said front surface of said plate and a second perforation aperture extent at said second distance beyond said front surface of said plate equal to said first perforation aperture extent.

6. A wall structure-mounted retention device as described in claim 1, further comprising at least two mounting surfaces extending from said front surface of said plate to a distance beyond said distance of said perforation beyond said rear surface.

7. A wall structure-mounted retention device, comprising:

a plate;

a front surface of said plate;

a rear surface of said plate;

at least one perforation in said plate configured to engage a retaining element and extending from said front surface of said plate to a predetermined distance beyond said rear surface of said plate;

a first perforation surface extending within each said perforation from said front surface of said plate to a predetermined distance beyond said front surface of said plate and said perforation angled less than ninety degrees;

a second perforation surface extending from the first perforation and extending within each said perforation from said predetermined distance beyond said front surface of said plate to a second predetermined distance beyond said front surface of said plate.

wherein said at least one perforation is configured to be removably engaged with a retaining element and said second perforation surface is configured to be in threaded engagement with a threaded fastener element.

8. A wall structure-mounted retention device as described in claim 7, wherein said second perforation surface is perpendicular to said front surface of said plate.

9. A wall structure-mounted retention device as described in claim 8, wherein said second perforation surface comprises a cylindrical perforation surface.

10. A wall structure-mounted retention device as described in claim 7, wherein said second perforation surface comprises a thread forming perforation surface.

11. A wall structure-mounted retention device as described in claim 10, wherein said thread forming perforation surface is configured to be removably engaged with a retaining element.

12. A wall structure-mounted retention device as described in claim 11, wherein said retaining element comprises a threaded fastener element.

13. A wall structure-mounted retention device as described in claim 7, wherein said first perforation surface is configured oblique to said front surface of said plate.

14. A method of retaining implements or materials to a wall structure, comprising the steps of:

accommodating a retaining element with a retention device corresponding to said wall structure, said retaining element capable of being removably engaged with at least one perforation of said retention device, wherein said at least one perforation has a first perforation surface extending within each said perforation from said front surface of said plate to a predetermined distance beyond said front surface of said plate and said first perforation angled less than ninety degrees, and a second perforation surface extending from the first perforation and extending within each said perforation from said predetermined distance beyond said front surface of said plate.

accommodating for threaded engagement of a threaded fastener element with said at least one perforation having a thread forming perforation surface;

accommodating for removable engagement of a storage element with said at least one perforation; and removably engaging a retaining element with said at least one perforation; and retaining an implement or material to the wall structure.

15. A method of retaining implements or materials to a wall structure as described in claim 14 wherein said steps of accommodating comprise accommodating for engagement with said second perforation surface.

16. A method of retaining implements or materials to a wall structure as described in claim 15 wherein said steps of accommodating comprise accommodating for threaded engagement of a threaded fastener element with said second perforation surface.

17. A method of retaining implements or materials to a wall structure as described in claim 15 wherein said steps of accommodating comprise accommodating for removable engagement of a storage element with said second perforation surface.

18. A method of retaining implements or materials to a wall structure as described in claim 14 further comprising the step of providing a retention device having a front and rear surface and at least one perforation extending a distance beyond said rear surface, said at least one perforation having a first and a second perforation surface, said first perforation surface extending within each said perforation from said front surface to a distance beyond said front surface, said second perforation surface extending within each said perforation from said distance beyond said front surface to a second distance beyond said front surface.

19. A method of retaining implements or materials to a wall structure as described in claim 18, further comprising the step of mounting said retention device to said wall structure by at least two mounting surfaces of said retention device extending from said front surface to a predetermined distance beyond said predetermined distance of said perforation beyond said rear surface.

20. A method of retaining implements or materials to a wall structure as described in claim 14, wherein said at least one perforation comprises a first and second perforation surface, wherein said step of removably engaging a retaining element comprises threadingly engaging a threaded fastener element with said second perforation surface.

* * * * *